US008813549B1

(12) United States Patent
Pao

(10) Patent No.: US 8,813,549 B1
(45) Date of Patent: Aug. 26, 2014

(54) TESTING APPARATUS FOR OFF-LOAD AND ON-LOAD UNHOOKING SIMULATION OF THE RELEASE DEVICE OF A CLOSED LIFEBOAT

(71) Applicant: Chen Yuan Pao, Kaohsiung (TW)

(72) Inventor: Chen Yuan Pao, Kaohsiung (TW)

( * ) Notice: Subject to any disclaimer, the term of this patent is extended or adjusted under 35 U.S.C. 154(b) by 37 days.

(21) Appl. No.: 13/845,127

(22) Filed: Mar. 18, 2013

(51) Int. Cl.
*G01M 17/02* (2006.01)
*G01N 33/00* (2006.01)

(52) U.S. Cl.
CPC ..... *G01N 33/00* (2013.01)
USPC ..... 73/118.01; 73/862.56; 114/365

(58) Field of Classification Search
USPC ..... 73/118.01, 118.04, 862.56; 114/365, 114/377, 378, 380
See application file for complete search history.

(56) References Cited

U.S. PATENT DOCUMENTS

| | | | | |
|---|---|---|---|---|
| 1,475,617 | A * | 11/1923 | Allbin | 114/380 |
| 1,625,736 | A * | 4/1927 | Menefee | 114/380 |
| 3,811,720 | A * | 5/1974 | Epstein | 294/82.34 |
| 4,379,579 | A * | 4/1983 | Mahan et al. | 294/82.36 |
| 4,461,233 | A * | 7/1984 | Nilsson | 114/378 |
| 7,360,498 | B1 * | 4/2008 | Mora et al. | 114/378 |
| 7,412,941 | B2 * | 8/2008 | Mora et al. | 114/378 |
| 7,832,350 | B2 * | 11/2010 | Mora et al. | 114/378 |
| 8,215,257 | B2 * | 7/2012 | Mora et al. | 114/378 |
| 8,511,248 | B2 * | 8/2013 | Mora et al. | 114/378 |
| 8,561,566 | B2 * | 10/2013 | Nielsen | 114/378 |
| 8,667,921 | B2 * | 3/2014 | Nielsen | 114/377 |

* cited by examiner

*Primary Examiner* — Freddie Kirkland, III

(57) ABSTRACT

A testing apparatus for off-load and on-load unhooking simulation of the release device of a closed lifeboat includes two main mechanisms, two hydraulic jacks, two suspension ring bases, a pressure distribution module, a manual hydraulic pump and an air pressure buffer combined together. The testing apparatus of this invention can carry out drill of simulating off-load and on-load unhooking state of the release device of a lifeboat under circumstances of no risk, able to ensure safety of the operators during drill.

7 Claims, 10 Drawing Sheets

TESTING APPARATUS FOR OFF-LOAD AND ON-LOAD UNHOOKING SIMULATION OF THE RELEASE DEVICE OF A CLOSED LIFEBOAT

BACKGROUND OF THE INVENTION

1. Technical Field

This invention relates to a testing apparatus for off-load and on-load unhooking simulation of the release device of a closed lifeboat, particularly to one installation for carrying out unhooking simulation in a lifeboat drill as so to enhance the safety of operators.

2. Description of the Prior Art

In view of the sinking accident of the Titanic passenger liner in 1912, which caused serious casualties, the International Maritime Organization (IMO) has paid much attention to the completion and maintenance of a ship's lifesaving equipment, and the International Convention for the Safety of Life at Sea (SOLAS) and the International Life-Saving Appliance Code (LSA) have prescribed that all the international voyage ships must be equipped with lifeboats and large merchant ships, passenger liners and ferry boats must periodically carry out operation drill of lifeboats and further prescribed that under what condition, it is necessary to carry out lifesaving drill when the ship's personnel is changed. The lifesaving system of a ship is the last line of defense of life safety at sea, having important function of rescuing a ship's personnel in case of emergency, and lifeboats are statutory lifesaving equipment of a ship and safety of the ship's lifeboats is worthy of attention whether during shipwreck or during lifesaving drill in normal times. Accidents happened endlessly all over the world during lifeboat drills, and the most of the accidents frequently happened during the lifeboat's launching which always caused serious casualties.

The Maritime Safety Committee of the International Maritime Organization prescribed on the paragraph "MSC 82/24 4.4.18.2.2" that a lifeboat must be able to off-load and on-load release hooks, and on-load release hooks must be able to bear 1.1 times of gross weight. On the paragraph "MSC 82/24 4.4.18.8" further prescribed that the strength of a lifeboat's on-load unhook must be able to bear 6 times of gross weight, and the suspending equipment used for maintenance and service of the unhook must have capacity of carrying the gross weight plus 1000 kgs. Conventional suspending equipment 1 employed for simulating hooks release of a lifeboat, as shown on FIG. 1, is generally provided with two chain brakes 10 respectively disposed with a chain 11 having one end fixed with a suspending hook 12. The two chain brakes 10 are respectively hung on two davit arms 13, and the two suspending hooks 12 are respectively hooked on the bow and the stern of a lifeboat 14. To carry out drill of simulating launching and hook release of the lifeboat 14, two people respectively on the bow and the stern of the lifeboat 14 must be ready to apply force at the same time to pull the chains 11 on the two chain brakes 10 for slightly lifting the lifeboat 14, letting the lifeboat 14 simulate shifting upward after launching, and at this time, the hook releasing of the lifeboat 14 can be performed, thus completing the drill which is the unhooking simulation of the lifeboat 14 after launching the lifeboat 14. However, it requires two peoples to operate the conventional suspending equipment at the same time for lifting the lifeboat 14; nevertheless, during pull of the chains 11, the strength applied by each person is not the same; therefore, the lifeboat 14 cannot be lifted in a horizontal and may produce a slanting state and result in failure in the releasing hooks. Further, the conventional suspending equipment has no indication function of lifting height and load and hence the two operators on the bow and the stern of the lifeboat 14 are unable to know the lifting state of the lifeboat; therefore, the lifeboat 14 may be lifted excessively and improperly to hit the davit arms or touch obstructers but still continue to be lifted, or the lifeboat may be pulled forcefully and improperly to cause damage. Furthermore, the conventional hook release drill can be only applicable to an off-load lifeboat. If a lifeboat is on-load, the strength of conventional suspending equipment cannot bear the pulling force produced by fall of gravity of the on-load lifeboat and is apt to be damaged by the fall of gravity and also likely to injure the lifeboat and the operators.

The illegal facts and the misgivings of safety of the conventional suspending equipment of a lifeboat are described as follows:

1. The carrying capacity of the suspending equipment is evidently deficient and safety coefficient is too low.
2. In a whole course, the suspending equipment needs to be operated in the high altitude with high risk.
3. The conventional suspending equipment is operated manually and independently at one side so the lifeboat cannot be suspended safely in horizontal mode, always making the bow and the stern of a lifeboat in different lifting height.
4. In operation, the conventional suspending equipment has no indicating function of lifting height and lifting load; therefore a lifeboat is frequently lifted excessively or forcefully and improperly pulled to cause damage.
5. The conventional suspending equipment is extremely heavy so it is hard to be fastened with the davit arm and the lifeboat and, being not exclusive tools, the conventional suspending equipment causes worry in safety.

A lifeboat must surely be examined whether or not the equipment can be operated normally before launching drill; otherwise failures of unhooking or early release hooks may occur during launching drill. Therefore, how to ensure operators' safety during drills of the lifeboat and provide a safe environment or condition for launching drill is very important.

SUMMARY OF THE INVENTION

The objective of this invention is to offer a testing apparatus for off-load and on-load unhooking simulation of the release device of a closed lifeboat, able to solve the problem that a conventional suspending equipment of a lifeboat has illegal facts and misgivings of safety during carrying out lifeboat's unhooking drill.

The testing apparatus for off-load and on-load unhooking simulation of the release device of a closed lifeboat includes two mechanisms respectively provided with a housing having one end disposed with a hook base with a hook hole. The housing has an interior formed with a sliding groove, and two walls oppositely bored with a plurality of displacement indicating holes. Each mechanism has two sides formed with a first notch and a second notch and a wall bored with a through hole, and the first notch and the second notch have their upper portions and lower portions respectively formed with a fixed base, called a D fixed base, a C fixed base, a B fixed base, and an A fixed base. The D fixed base, the C fixed base, the B fixed base and the A fixed base are respectively bored with a cross insert groove, and the D fixed base has a wall formed with a fixing insert hole communicating with the cross insert groove of the D fixed base, with a fixing member secured in the fixing insert hole. The C fixed base has two mutually perpendicular walls respectively bored with a pin hole communicating with the cross insert groove, and one of the two mutually perpendicular pin holes is inserted therein with a secondary lifting anchor pin. The A fixed base also has two mutually perpendicular walls respectively formed with a pin hole communicating with the cross insert groove of the A fixed base, and one of the two mutually perpendicular pin holes has a primary anchor pin inserted therein. Two hydraulic jacks are respectively received in the housing of the two main mechanisms, and the plunger of each hydraulic jack is set thereon with a sliding carriage positioned in the sliding groove of the housing and having an upper end provided with a mark that corresponds with the displacement indicating hole on the wall of the housing, and the sliding carriage is pivotally installed therein with a wheel. The hydraulic jack has its oil pipe connector extending out of the through hole of the housing and is secured in the housing by a jack-fixing seat. Two suspension ring bases are respectively connected with the main mechanism by a chain, and each suspension ring base is pivotally installed with a wheel and bored with a hook hole. The chain has one end set to be a fixed end that is secured in the cross insert groove of the D fixed base by a fixing member on the main mechanism. The chain first passes around the wheel in the suspension ring base and then is orderly inserted through the cross insert groove of the C fixed base and the first notch of the main mechanism and through the cross insert groove of the B fixed base and then passes around the wheel in the sliding groove and is inserted through the cross insert groove of the A fixed base. The chain has another end extending out of the second notch at another side of the main mechanism and provided with a hoop. A pressure distribution module is disposed with two hydraulic oil pipes respectively connected with the oil pipe connector of the hydraulic jack in the two main mechanisms, having one side provided with a transfer valve. A manual hydraulic pump is connected with the pressure distribution module, and an air pressure buffer is connected with the transfer valve at one side of the pressure distribution module. A lifeboat's launching drill can be simulated by means of the testing apparatus for carrying out drill of off-load and on-load unhooking of the release device.

The two main mechanisms of the testing apparatus of this invention are respectively assembled on two davit arms, and the two suspension ring bases are respectively fastened on the bow and the stern of a lifeboat. A lifeboat can steadily and smoothly be suspended and lifted by the two main mechanisms and the two suspension ring bases.

The two main mechanisms of the testing apparatus of this invention are respectively assembled on the bow and the stern of a lifeboat, and the two suspension ring bases are respectively fastened on two davit arms, that is, the main mechanisms are reversed to be firmly clasped in the lifeboat, easy and labor-saving in assembly.

The secondary lifting anchor pin of the testing apparatus of this invention is connected to the housing by a rope and the primary lifting anchor pin is connected to the housing by another rope.

The housing of the testing apparatus of this invention is provided with a protective pad at one end facing the hook base and has two sides respectively mounted with a protective cover.

The manual hydraulic pump of the testing apparatus of this invention is provided with a hand-pressing lever, an output indicating gauge and a non-return valve switch.

The air pressure buffer of the testing apparatus of this invention is set with a pressure gauge, disposed with a piston and spring in the interior and bored with an air intake and an exhaust hole.

To sum up, this invention has the following advantages:

1. By the testing apparatus of this invention, a real unhooking of the release device of a lifeboat can be performed under safe circumstances in lifeboat's drills, able to enhance safety of the operators in the drills.

2. The testing apparatus of this invention is powerful in integral structural strength, light in weight and high in safety coefficient, able to lower the burden of personnel in maintenance and economize cost in repairs.

3. The hydraulic actuation mode of this invention can produce extremely great lifting force with little output of strength, safe and labor-saving in operation.

4. The main mechanisms of this invention can be reversed to be firmly fastened on a lifeboat and the suspension ring bases are fastened on the davit arm, letting the heavy components located at a lower side and the light components at an upper side and thus form a labor-saving mode. Thus, the testing apparatus of this invention can quickly and safely be hung between the lifeboat and the davit arms.

5. The pressure distribution module cooperating with the two main mechanisms can ensure a lifeboat to be suspended horizontally.

6. The strength output indicating gauge provided on the manual hydraulic pump enables operators to clearly observe the extent of output of lifting and analyze if there is any obstructer influencing the lifting work of the lifeboat by means of the known weight of the lifeboat, thus ensuring safety in operation and drill.

7. The displacement indicating holes provided on the main mechanism enable an operator to know and control the lifting height of the lifeboat so the operator can repeatedly operate the unhooking apparatus under safe conditions.

8. The plural fixed bases provided on the main mechanisms, the primary lifting anchor pin and the secondary lifting anchor pin can set a lifting height at each stage for the chain. In case of making errors or accidentally causing leakage of pressure in operation, the lifeboat can merely be lowered to reach a lifting height preset, able to ensure safety in operation and drill.

9. The air pressure buffer of this invention can mitigate the falling force of the lifeboat during on-load unhooking motions, able to prevent the lifeboat and the suspending equipment from being forcefully pulled when the lifeboat is unhooked to fall, achieving safety in operation and drill.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
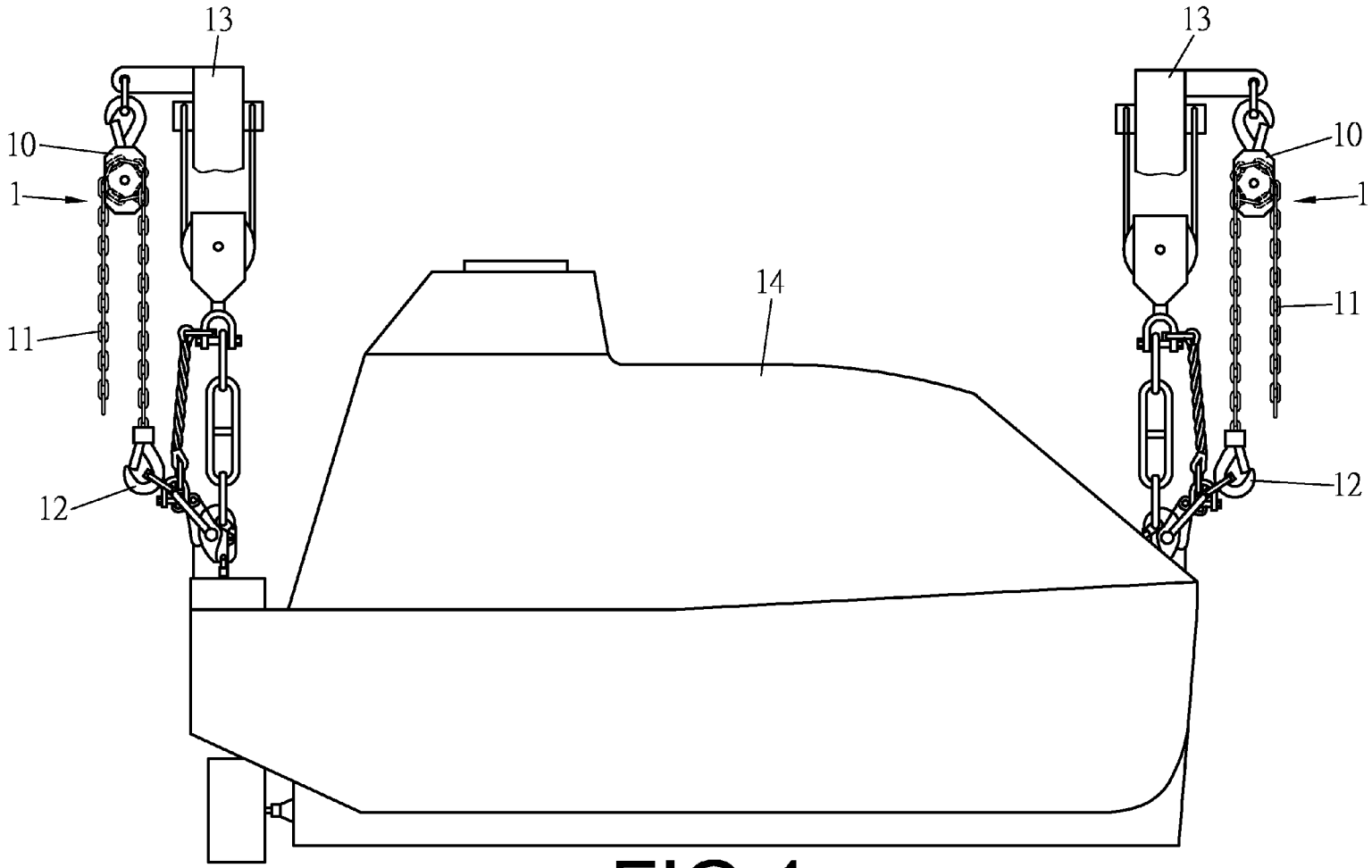
FIG.1 (PRIOR ART)
FIG. 1 is a schematic view a preferred embodiment of a conventional suspending equipment of a lifeboat.

A preferred embodiment of a testing apparatus for off-load and on-load unhooking simulation of the release device of a closed lifeboat in the present invention, as shown in FIGS. 2-5, includes two main mechanisms 2, two hydraulic jacks 4, two suspension ring bases 5, a pressure distribution module 6, a manual hydraulic pump 7 and an air pressure buffer 8 as main components combined together.

Each main mechanism 2 is provided with a housing 20 having one end formed with a hook base 21 with a hook hole 22, and another end disposed with protecting pad 23, further having the interior formed with a sliding groove 24 and two walls respectively and oppositely bored with a plurality of displacement indicating holes 25. The housing 20 has two sides respectively formed with a notch (a first notch 26, a second notch 27), and one of two walls of the housing 20 is bored with a through hole 28 and two sides of the housing 20 are respectively mounted with a protective cover 29. Further, the first notch 26 and the second notch 27 at the two sides of the housing 20 have their upper and lower sides respectively provided with a fixed base (a D fixed base 30, a C fixed base 31, a B fixed base 32, an A fixed base 33), and the D fixed base 31, the C fixed base 31, the B fixed base 32 and the A fixed base 33 are respectively disposed with a crossed insert groove 300, 310, 320, 330, and the D fixed base 30 has a wall bored with a fixing insert hole 301 communicating with the cross insert groove 300 and having a fixing piece 302 positioned therein. The C fixed base 31 has two mutually perpendicular walls respectively bored with a pin hole 311 communicating with the cross insert groove 310, and one of the two pin holes 311 is inserted therein with a secondary lifting anchor pin 312 connected to the housing 20 by a rope 313. The A fixed base 33 has two mutually perpendicular walls respectively provided with a pin hole 331 communicating with the cross insert groove 330, and one of the two pin holes 331 is inserted therein with a primary lifting anchor pin 332 connected to the housing 20 by a rope 333.

The two hydraulic jacks 4 respectively assembled in the housings 20 of the two main mechanisms 2 have their plungers 40 respectively provided with a sliding carriage 41 positioned in the sliding groove 24 of the housing 20 and having an upper edge provided with a mark 42 that corresponds with one of the displacement indicating holes 25 in the wall of the housing 20, and when zeroed, the mark 42 is positioned corresponding with the first displacement indicating hole 25, and the sliding carriage 41 is pivotally provided with a wheel 43 in the interior. The hydraulic jacks 4 has an oil pipe connector 44 inserted out of the through hole 28 of the housing 20. Each hydraulic jack 4 is secured in the housing 20 by means of a jack-fixing seat 45.

Each suspension ring base 5 to be connected with the main mechanism 2 by a chain 50 is pivotally provided with a wheel 51 and a hooking hole 52. The chain 50 has one end set to be a fixed end 500 that is secured with the D fixed base 30 by the fixing piece 302 on the D fixed base 30 of the main mechanism 2. The chain 50 circuitously passes around the wheel 51 of the suspension ring base 5, and then is orderly inserted through the cross insert groove 310 of the C fixed base 31 and the first notch 26 of the housing 20 and through the crossed insert groove 320 of the B fixed base 32 and then passes around the wheel 43 of the sliding carriage 41 and goes through the cross insert groove 330 of the A fixed base 33 and finally extends out the second notch 27 at another side of the housing 20. The chain 50 has another end provided with a hoop 53.

The pressure distribution module 6 is provided with two hydraulic oil pipes 60 having their ends respectively connected to the oil pipe connector 44 of the hydraulic jack 4 of the main mechanism 2 and has one side disposed with a transfer valve 61.

The manual hydraulic pump 7 connected with the pressure distribution module 6 is provided with a hand pressing lever 70, a strength output indicating gauge 71 and a non-return valve switch 72.

The air pressure buffer 8 connected with the transfer valve 61 at one side of the pressure distribution module 6 is installed thereon with a pressure gauge 80, provided with a piston 81 and a spring 82 in the interior and bored with an air intake 83 and an exhaust hole 84.

Figure 2:
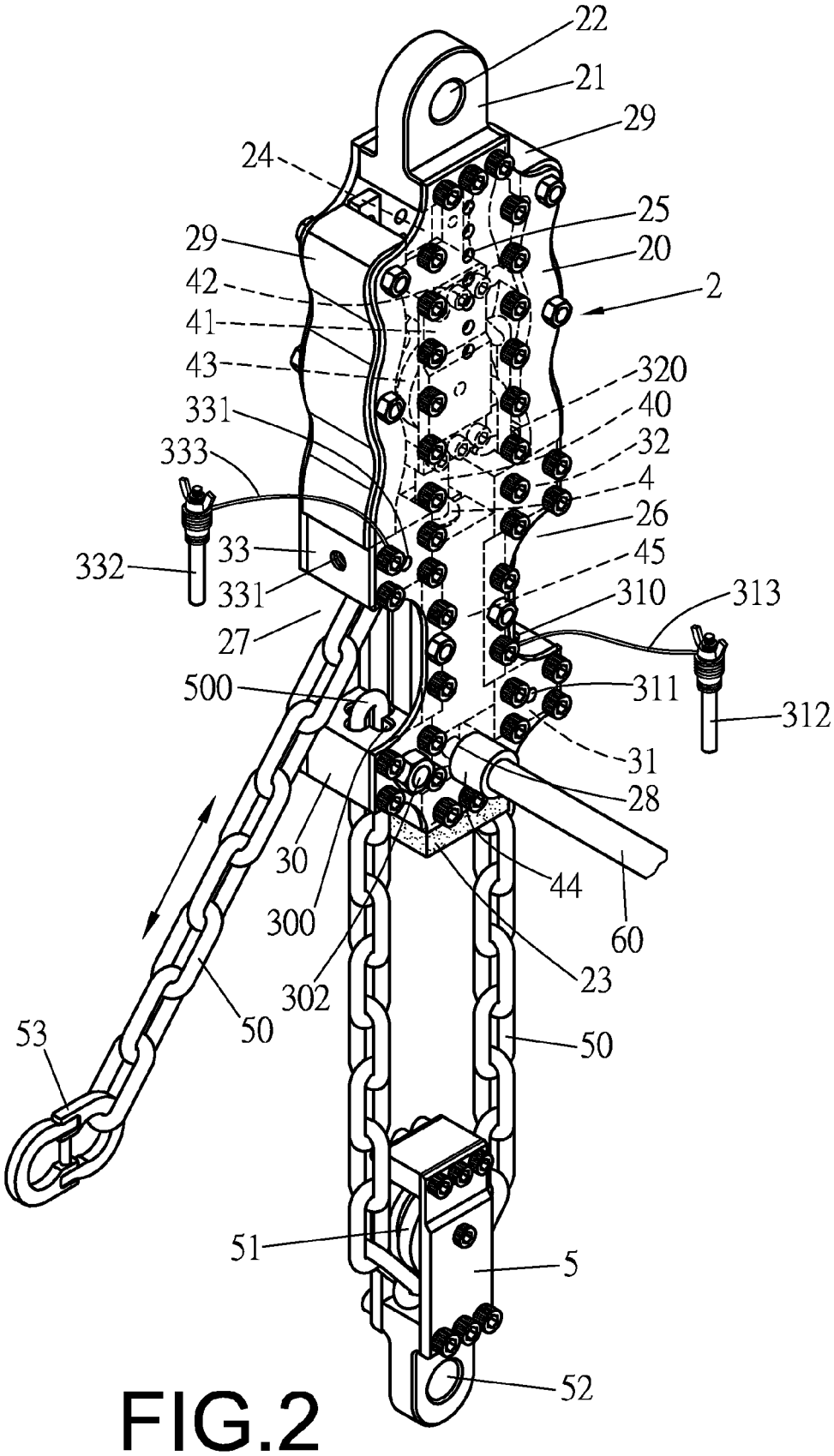
FIG. 2 is a perspective view a preferred embodiment of a main mechanism of a testing apparatus in the present invention.
Figure 3:
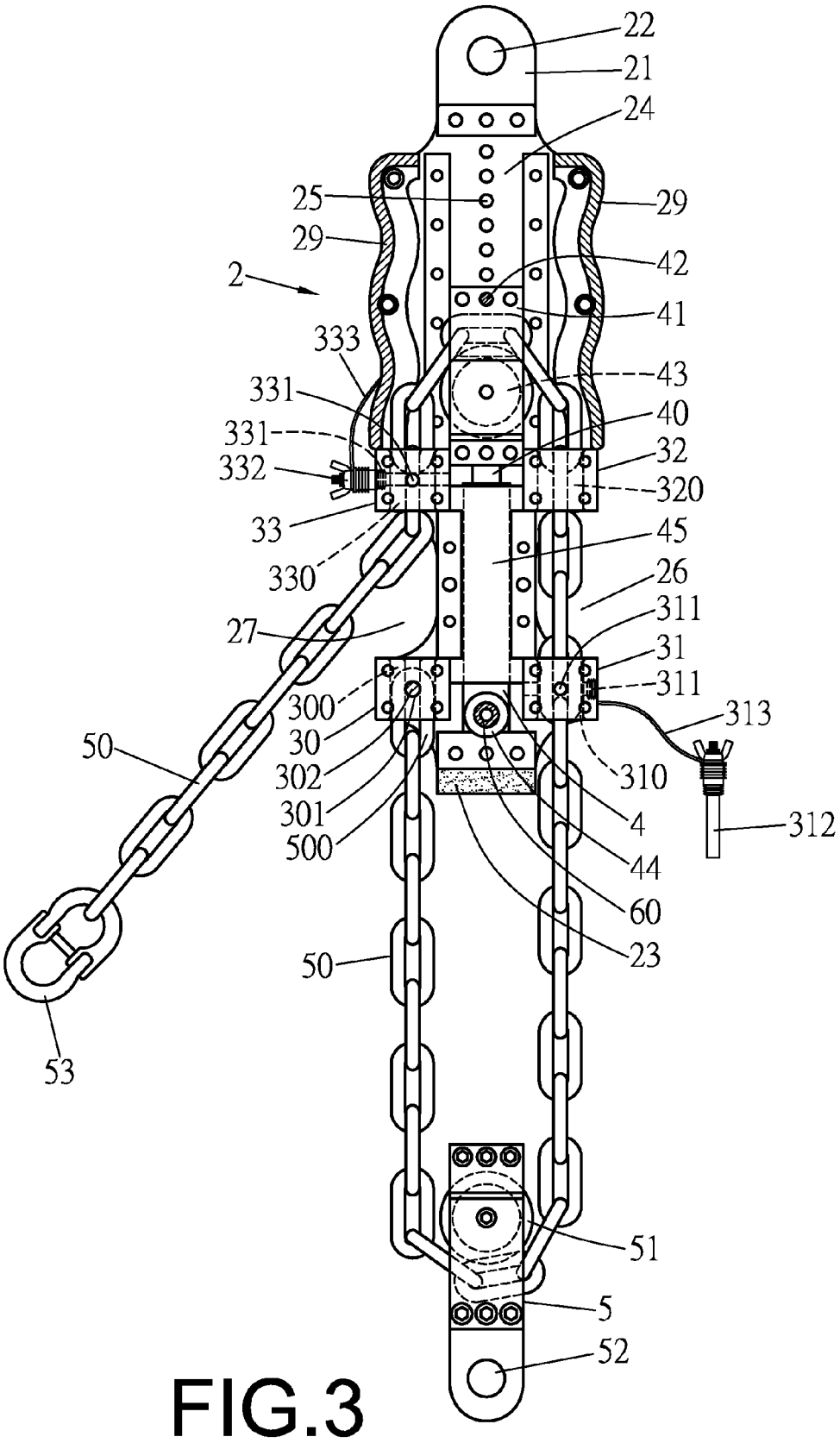
FIG. 3 is a cross-sectional view the preferred embodiment of the main mechanism of the testing apparatus in the present invention.
Figure 4:
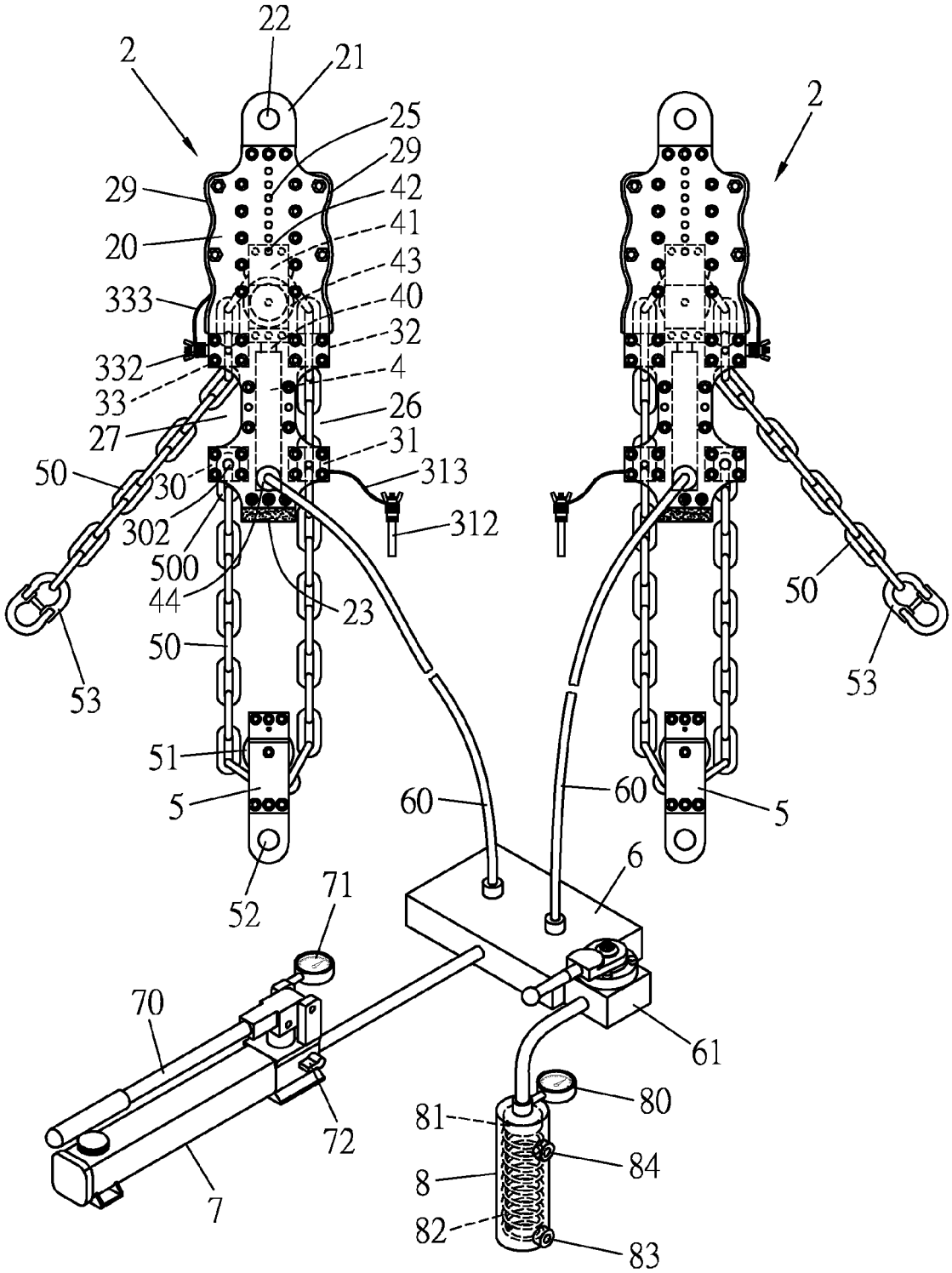
FIG. 4 is a schematic view the preferred embodiment of a whole structure of the testing apparatus in the present invention.
Figure 5:
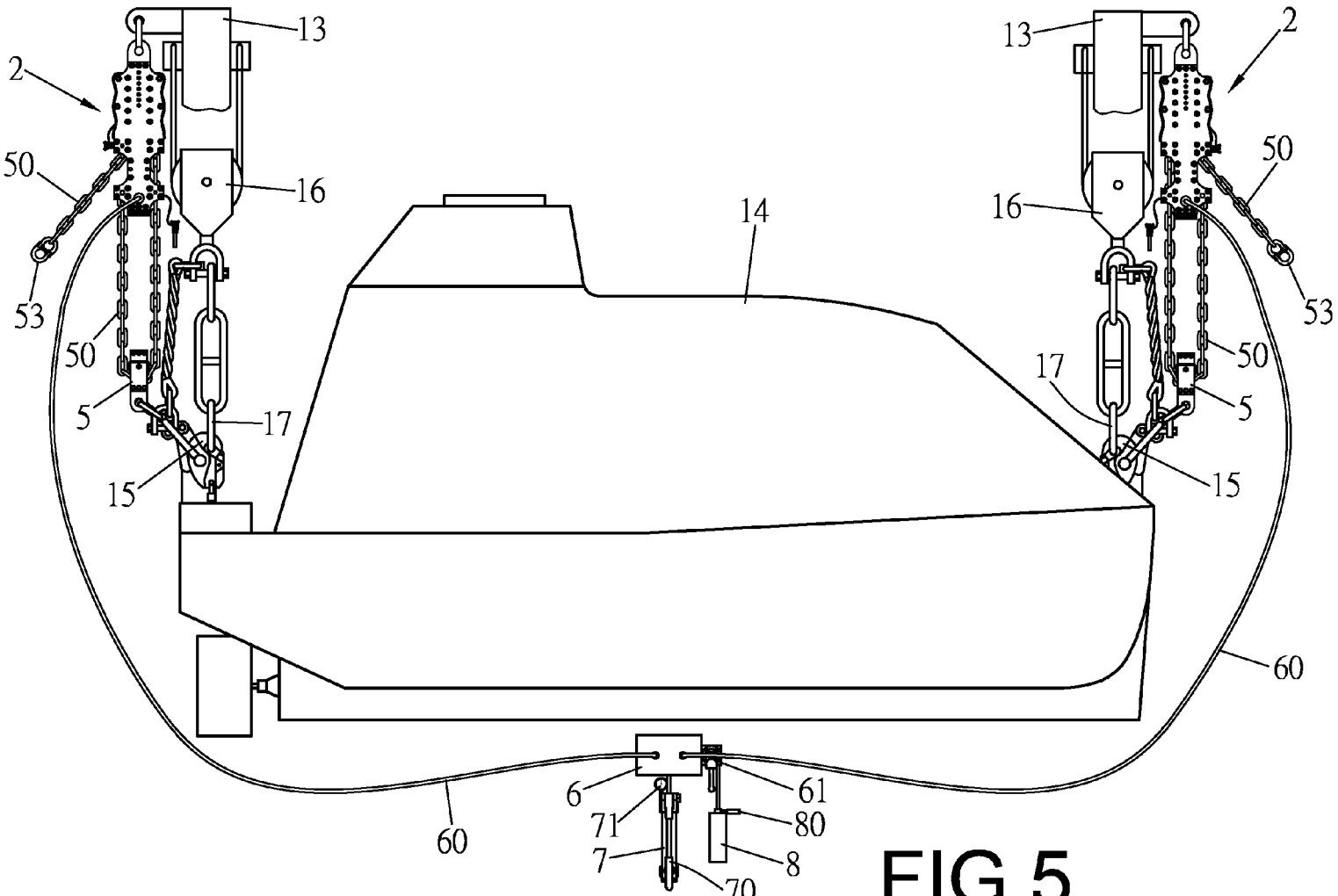
FIG. 5 is a schematic view the preferred embodiment of the testing apparatus hung on a lifeboat and davit arms for use in the present invention.
Figure 6:
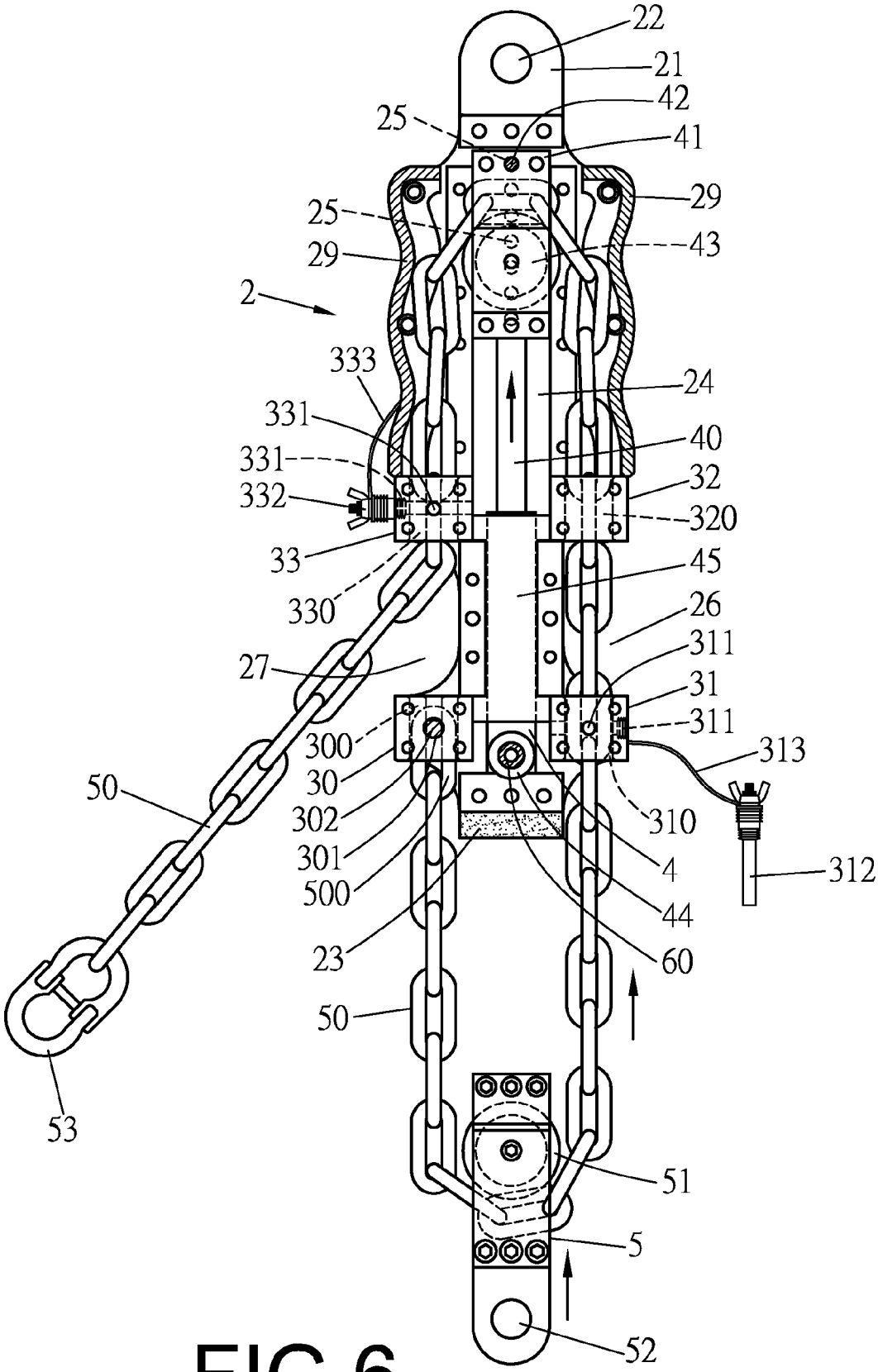
FIG. 6 is a schematic view the preferred embodiment of the testing apparatus having a hydraulic jack lifting a chain upward for simulating a launching state of a lifeboat in the present invention.

In using, referring to FIGS. 2-6, firstly, the hook bases 21 of the two main mechanisms 2 are respectively fastened on two davit arms 13 by two fasteners 90, and the two suspension ring bases 5 are respectively clasped on the bow and the stern of a lifeboat 14 by another two fasteners 91, as shown in FIG. 5. Since the suspending distance between the davit arm 13 and the lifeboat 14 is uncertain; therefore, when the main mechanism 2 and the suspension ring base 5 are respectively fastened between the davit arm 13 and the lifeboat 14 and it is found that the chain 50 between the main mechanism 2 and the suspension ring base 5 is in an excessively loose or excessively tight state, the chain 50 has to be first tightened or loosened and then positioned anew. To tighten or loosen the chain 50, only remove the primary lifting anchor pin 332 on the main mechanism 2 from the pin hole 331 of the A fixed base 33, as shown in FIG. 2. At this time, the chain is no longer positioned by the primary lifting anchor pin 332 and able to be moved upward or downward and adjusted to proper tightness. After being adjusted in tightness, the chain 50 is immovably positioned again by having the primary lifting anchor pin 332 inserted in both the pin hole 331 of the A fixed base 33 and a chain hole of the chain 50, as shown in FIG. 3. Thus, the main mechanisms 2 and the suspension ring bases 5 of the testing apparatus of this invention can be assembled between the davit arms 13 and the lifeboat 14 to complete suspending. Lastly, the two hydraulic oil pipes 60 of the pressure distribution module 6 are respectively connected with the oil pipe connectors 44 of the hydraulic jacks 4 inside the two main mechanisms 2, as shown in FIG. 4, thus able to simulate the launching and lifting state of a lifeboat 14 and able to be ready for carrying out a unhooking drill of release device of a lifeboat 14. To simulate the launching and floating-up motion of a lifeboat 14, simply repeatedly pull up and press down the hand pressing lever 70 of the manual hydraulic pump 7 to have the hydraulic oil in the hydraulic pump 7 extruded outward to get into the pressure distribution module 6 and simultaneously, the pressure distribution module 6 will have the hydraulic oil respectively conveyed to the hydraulic jack 4 inside the two main mechanisms 2 via the two hydraulic oil pipes 60, as shown in FIG. 4. In the main time, the hydraulic oil will push the plunger 40 of the hydraulic jack 4 to move outward and push the sliding carriage 41 to move upward and slide and shift in the sliding groove 24 and meanwhile, the wheel 43 will shift upward together with the sliding carriage 41 to drive the chain 50 together with the suspension ring base 5 to move upward, as shown in FIG. 6, thus able to lift the lifeboat 14. At this time, an operator can clearly know the force output extent of the manual hydraulic pump 7 via the output indication gauge 71 of the manual hydraulic pump 7 and also can analyze if there is any obstructer to affect operation of lifting the lifeboat 14 by the known weight of the lifeboat 14 (a weight of a lifted object), thus able to ensure safety of operation. By the pressure boosting mode of the manual hydraulic pump 7, the maximum lifting force can reach to 9100 kgs, while the maximum hand-pressing force only needs 42 kgs, that is, an extremely heavy object can be lifted with little force applied, able to greatly save force applied for lifting a lifeboat 14. Further, an operator can clearly know the lifting height of the lifeboat 14 through the displacement indicating holes 25 of the housing 2. For instance, the space between every two displacement indicating holes 25 is 20 mm and there are seven displacement indicating holes 25 provided on the housing 20 (the first hole being a fiducially hole) so the maximum lifting height every time is 120 mm, thus able to definitely control the lifting height of the lifeboat 14. In case of making errors in operation or accidentally causing leakage of pressure, the lifeboat 14 will only be lowered to a lifting height preset, and the hydraulic jacks 4 inside the two main mechanism 2 are simultaneously, controlled to operate by the single manual hydraulic pump 7 so the lifeboat 14 can smoothly and steadily be lifted, thus enabling the lifeboat 14 to be horizontally lifted by only one operator for saving operation manpower during drill. By so designing, a lifeboat's off-load launching state can be simulated under safe circumstances and a drill of real unhooks can be preformed in an environment of no risk and hence, the lifeboat 14 is unnecessary to be really hung and launched, able to avoid accidents caused during drill of launching for protecting safety of persons who participate in drill.

Figure 7:
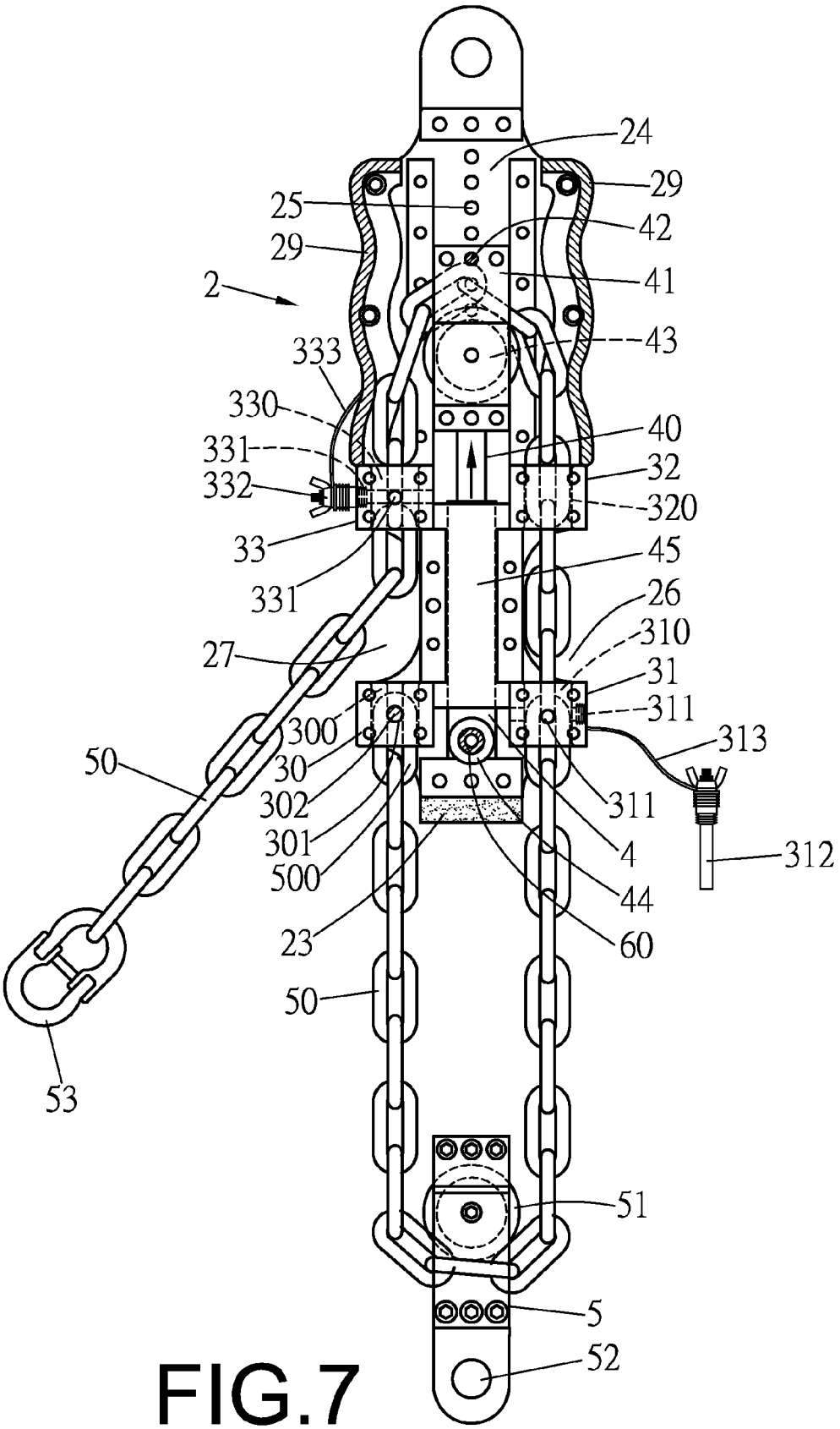
FIG. 7 is a schematic view the preferred embodiment of the testing apparatus having a sliding carriage in the main mechanism shifting to simulate an on-load state of a lifeboat in the present invention.
Figure 8:
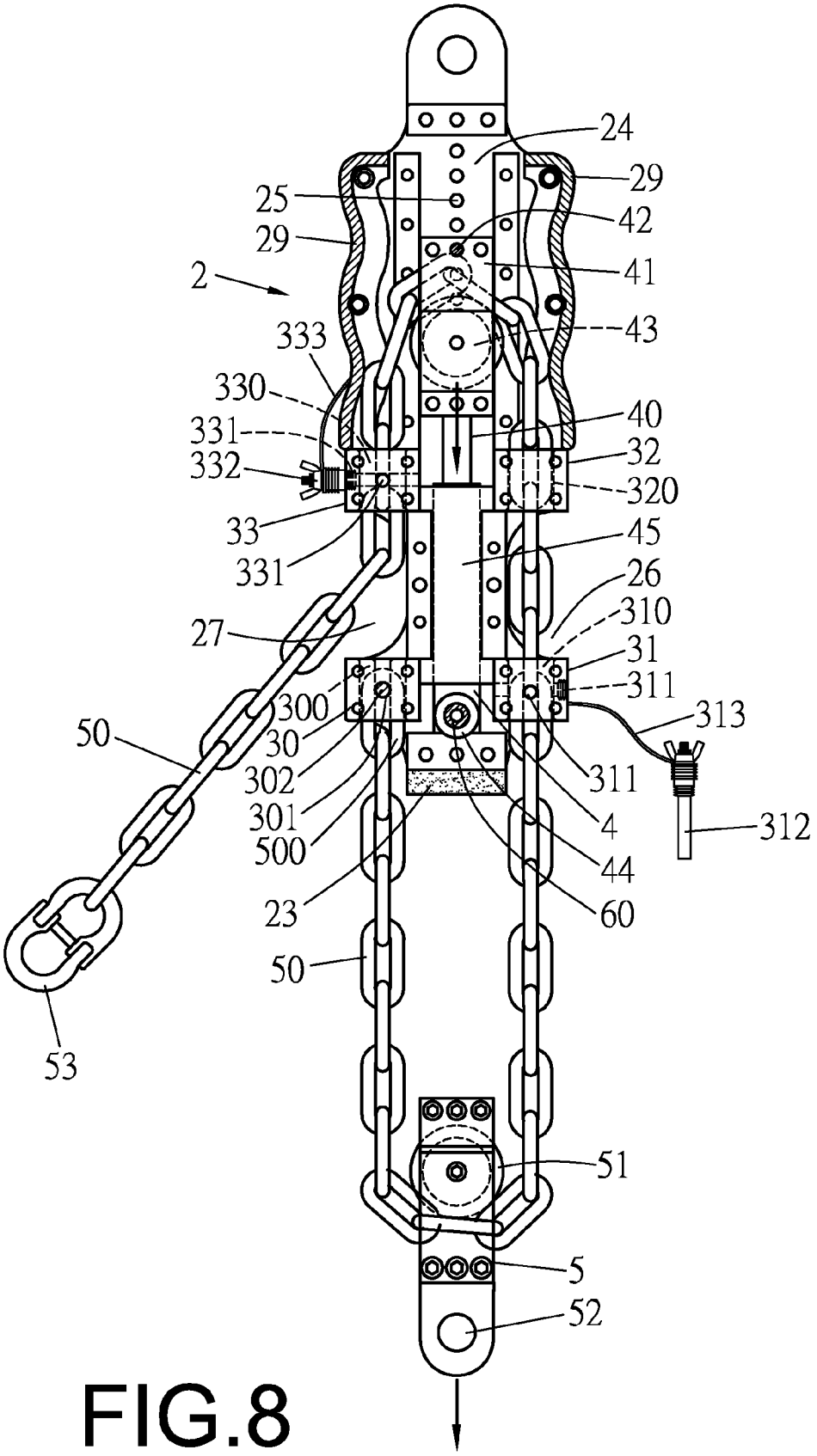
FIG. 8 is a schematic view the preferred embodiment of the testing apparatus having the sliding carriage and a plunger moved slowly in the interior of the main mechanism during on-load release of hooks of a lifeboat in the present invention.

To simulate the on-load state of a lifeboat, referring to FIGS. 5 and 7, when the lifeboat 14 is on-load and the fastening condition between the boat hooks 15 of a lifeboat 14 and the suspending ring 17 of the pulleys 16 is in a taut state due to gravity, the hand pressing lever 70 of the manual hydraulic pump 7 is pulled up and pressed down to have hydraulic oil conveyed into the hydraulic jack 4 inside the two main mechanisms 2 via the pressure distribution module 6 to push the plungers 40 of the hydraulic jacks 4 to move outward and actuate the sliding carriages 41 and the wheel 43 to shift upward a little and at this time, an operator can clearly know the displacement of the suspension ring bases 5 via the mark 42 on the sliding carriage 41. If the on-load lifeboat 14 is set to shift upward for 40 mm, letting the upper edge of the sliding carriage 41 shift to the location of the third displacement indicating hole 25 on the housing 20, the chain 50 will be pulled straight and the hand pressing lever 70 on the manual hydraulic pump 7 will be stopped being pulled and pressed to let the non-return valve switch 72 be in an off state; therefore, the hydraulic oil is impossible to flow back to the manual hydraulic pump 7 and the sliding carriages 41 can be fixed in position, thus setting a lifeboat's on-load state and able to carry out on-load unhooking drill. To carry out on-load unhooking drill, the transfer valve 61 at on side of the pressure distribution module 6 has to be opened first. When the lifeboat 14 is unhooked to fall downward, the suspension ring bases 5 and the chains 50 will be pulled downward by gravity, as shown in FIG. 8, and the sliding carriages 41 and the wheel 43 inside the main mechanisms 2 will be actuated by the chains 50 to move downward. Simultaneously, the plungers 40 will be pushed by the sliding carriages 41 to move inward to compress the hydraulic oil in the hydraulic jacks 4 to flow back to the hydraulic oil pipes 60 and into the pressure distribution module 6. Since the non-return valve switch 72 is in an off state; therefore, with the hydraulic oil impossible to flow back to the manual hydraulic pump 7 and, on account of the principle that air can be compressed but liquid cannot, the hydraulic oil will get into the air pressure buffer 8 through the transfer valve 61 to push the piston 81 to compress gas (nitrogen) in the air pressure buffer 8 to form buffer force to cooperate with the buffer force of the spring 82 in the hydraulic buffer 8 to enable the plungers 40 of the hydraulic jacks 4 to move inward slowly. Apparently, the air pressure buffer 8 of this invention has excellent buffer function of retarding the instant and powerful falling force produced when a lifeboat is unhooked to fall downward, able to prevent the lifeboat 14 and the suspending equipment from being damaged by powerful pull force produced when the lifeboat 14 is unhooked and ensure safety during on-load unhooking drills.

Figure 9:
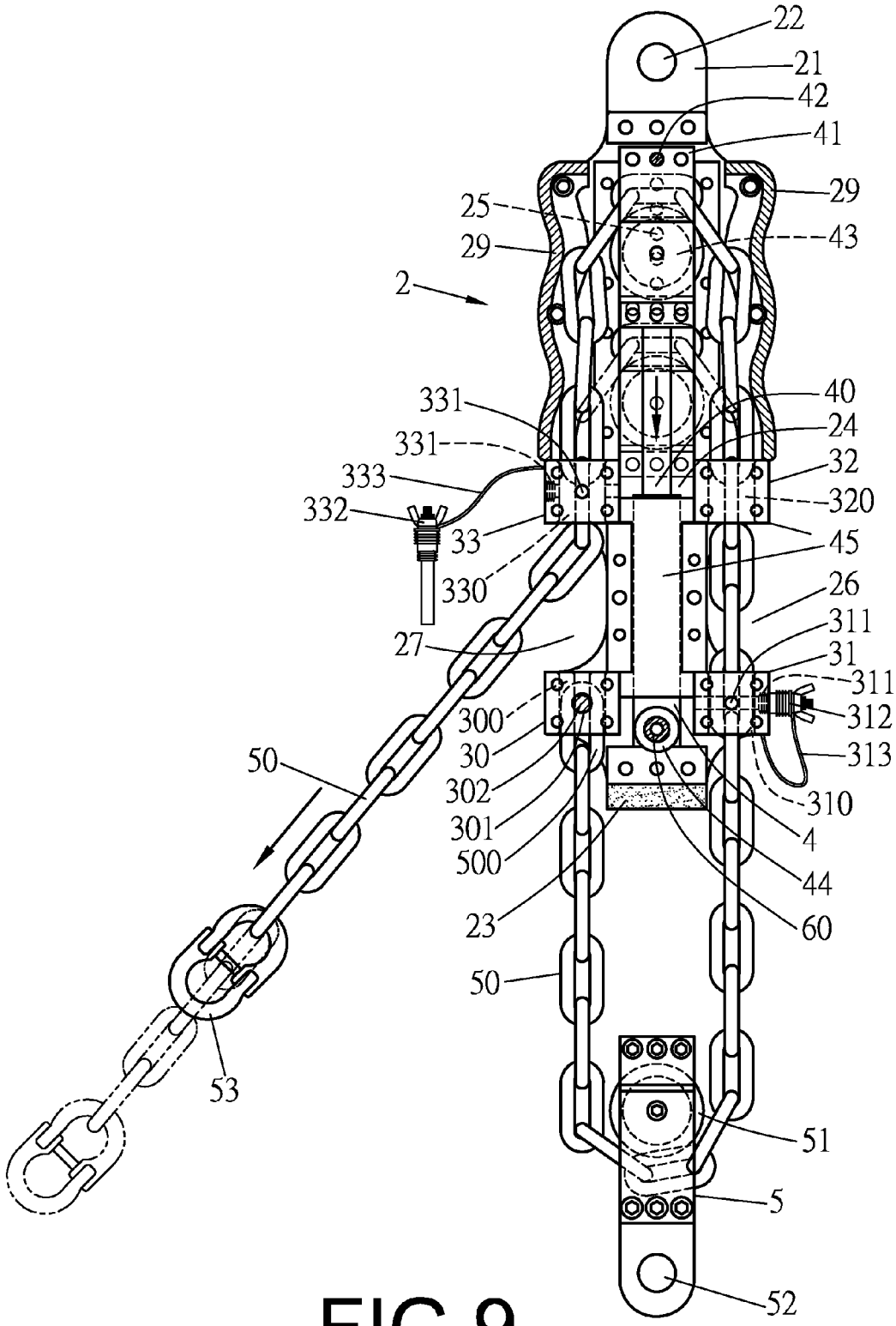
FIG. 9 is a schematic view the preferred embodiment of the testing apparatus having the sliding carriage shifted downward and then pulled renew in the present invention.

Referring to FIG. 9, after the sliding carriage 41 is moved to the uppermost end of the sliding groove 24 because of previous operation and is to be moved upward once more, only have the secondary lifting anchor pin 312 inserted in one pin hole 311 of the C fixed base 31 and the chain hole of the chain 50 to position a part of the chain 50 that is positioned outside the main mechanism 2 and passes around the suspension ring base 5. Subsequently, the primary lifting anchor pin 332 is removed out of the pin hole 331 of the A fixed base 33, and the non-return valve switch 72 of the manual hydraulic pump 7 is turned on to enable the hydraulic oil in the hydraulic jack 4 to flow back to the manual hydraulic pump 7 via the hydraulic oil pipes 60 for actuating the plunger 40 in the hydraulic jack 4 to move inward and drive both the sliding carriage 41 and the wheel 43 to shift downward. At this time, superfluous chain 50 in the housing 20 can be pulled out through the cross insert groove 330 of the A fixed base 33 to let the chain 50 inside the housing 20 form a proper tightness. Then, the primary lifting anchor pin 332 is once again inserted in one pin hole 331 of the A fixed base 33 and the chain hole of the chain 50 to position the chain 50 anew. Afterward, the secondary lifting anchor pin 312 is removed from the pin hole 311 of the C fixed base 31, thus finishing setting for pulling and extending the chain 50 for once more. To accomplish setting of pulling the chain 50 anew, it is needless to remove the main mechanisms 2 from the davit arms 13, convenient and safe in operation.

Figure 10:
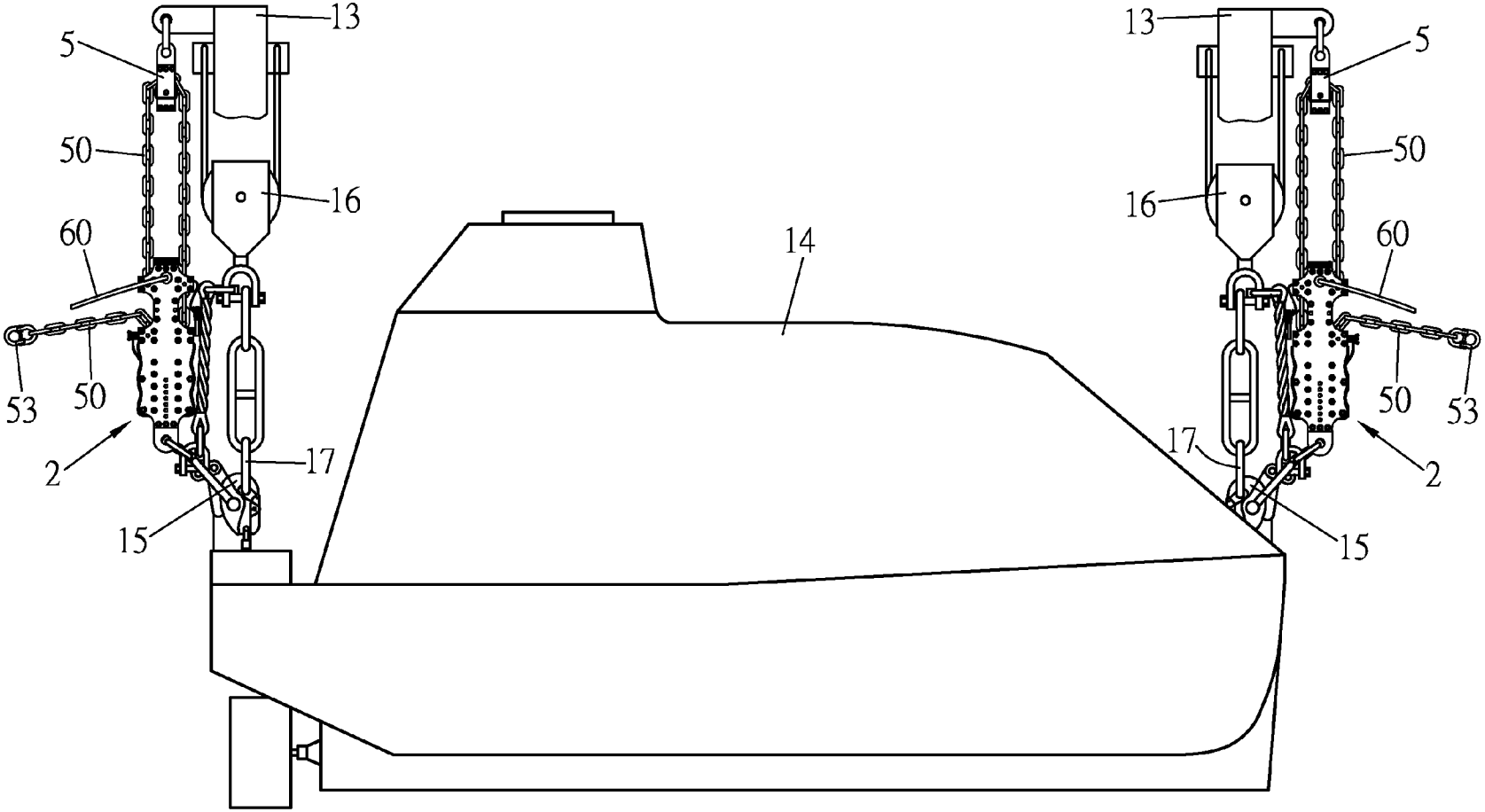
FIG. 10 is a schematic view of the preferred embodiment of the testing apparatus having the main mechanism reverted and fastened on a lifeboat in the present invention.

Referring to FIG. 10, the main mechanisms 2 of this invention can also be hung reversely to be respectively fastened on the bow and the stern of a lifeboat 14, and the two suspension ring bases 5 are respectively clasped on the two davit arms 13, letting the heavy components of the testing apparatus located at a lower side and the light components at an upper side. Thus, the testing apparatus of this invention can be installed in a labor-saving way and can be safely and quickly hung and assembled between a lifeboat 14 and two davit arms 13. This reversed testing apparatus can be operated in the same mode as that described previously and can attain the same efficacy.

While the preferred embodiment of the invention has been described above, it will be recognized and understood that various modifications may be made therein and the appended claims are intended to cover all such modifications that may fall within the spirit and scope of the invention.

What is claimed is:

1. A testing apparatus for off-load and on-load unhooking simulation of the release device of a closed lifeboat comprising two main mechanisms, each said main mechanism provided with a housing, said housing having one end disposed with a hook base, said hook base bored with a hook hole, said housing formed with a sliding groove in an interior, said housing having two sidewalls oppositely provided with a plurality of displacement indicating holes, said main mechanism having two sides respectively formed with a first notch and a second notch, said housing having one wall bored with a through hole, said first notch and said second notch at two sides of said main mechanism having their upper portions and lower portions respectively formed with a fixed base (a D fixed base, a C fixed base, a B fixed base, an A fixed base), said D fixed base, said C fixed base, said B fixed base and said A fixed base respectively bored with a cross insert groove, said D fixed base having a wall bored with a fixing insert hole communicating with said cross insert groove of said D fixed base, said fixing insert hole having a fixing piece set therein, said C fixed base having two mutually perpendicular walls respectively disposed with a pin hole communicating with said cross insert groove, said C fixed base having one of two mutually perpendicular pin holes inserted therein with a secondary lifting anchor pin, said A fixed base having two mutually perpendicular walls respectively bored with a pin hole communicating with said cross insert groove of said A fixed base, said A fixed base having one of two mutually perpendicular pin holes inserted therein with a primary lifting anchor pin;

two hydraulic jacks respectively installed in said housings of said two mechanisms, each said hydraulic jack having a plunger set thereon with a sliding carriage, said sliding carriage positioned in said sliding groove of said housing, said sliding carriage having an upper edge provided with a mark, said mark corresponding with said displacement indicating hole on a wall of said housing, said sliding carriage pivotally installed with a wheel in an interior, said hydraulic jack having an oil pipe connector extending out of said through hole of said housing, said hydraulic jack secured in said housing by a jack-fixing seat;

two suspension ring bases respectively connected with said main mechanisms by a chain, each said suspension ring base pivotally provided thereon with a wheel, said suspension ring base formed with a hook hole, said chain having one end set to be a fixed end, said fixed end of said chain secured in said cross insert groove of said D fixed base by a fixing member of said main mechanism, said chain passing around said wheel in said suspension ring base and orderly inserted through said cross insert groove of said C fixed base in said main mechanism and through said first notch of said main mechanism, said chain continuously inserted through said cross groove of said B fixed base and passing around said wheel in said sliding carriage and then inserted through said cross groove of said A fixed base, said chain having another end extending out of said second notch at another said of said main mechanism, said another end of said chain provided with a hoop;

a pressure distribution module disposed with two hydraulic oil pipes, said two hydraulic oil pipes respectively connected with said oil pipe connectors of said hydraulic jacks in said main mechanisms, said pressure distribution module having one side provided with a transfer valve;

a manual hydraulic pump connected with said pressure distribution module, and an air pressure buffer connected with said transfer valve at one side of said pressure distribution module.

2. A testing apparatus for off-load and on-load unhooking simulation of the release device of a closed lifeboat as claimed in claim 1, wherein said two main mechanisms are respectively assembled on two davit arms, and said two suspension ring bases are respectively fastened on a bow and a stern of a lifeboat.

3. The testing apparatus for off-load and on-load unhooking simulation of the release device of a gravity type lifeboat as claimed in claim 1, wherein said two main mechanisms are respectively assembled on the bow and the stern of a lifeboat, and said two suspension ring bases are respectively fastened with said two davit arms.

4. The testing apparatus for off-load and on-load unhooking simulation of the release device of a closed lifeboat as claimed in claim 1, wherein said secondary lifting anchor pin is connected to said housing by a rope, and said primary lifting anchor pin is connected to said housing by another rope.

5. The testing apparatus for off-load and on-load unhooking simulation of the release device of a closed lifeboat as claimed in claim 1, wherein said housing is provided with a protective pad at one end facing said hook base, and said housing has two sides respectively mounted with a protective cover.

6. The testing apparatus for off-load and on-load unhooking simulation of the release device of a closed lifeboat as claimed in claim 1, wherein said manual hydraulic pump is provided with a hand pressing lever, an output indicating gauge and a non-return valve switch.

7. The testing apparatus for off-load and on-load unhooking simulation of the release device of a closed lifeboat as claimed in claim 1, wherein said air pressure buffer is installed thereon with a pressure gauge, said air pressure buffer provided with a piston and a spring in an interior, said air pressure buffer bored with an air intake and an exhaust hole.

* * * * *